US006251256B1

(12) United States Patent
Blay et al.

(10) Patent No.: US 6,251,256 B1
(45) Date of Patent: Jun. 26, 2001

(54) PROCESS FOR ELECTROCHEMICAL OXIDATION OF AN ALDEHYDE TO AN ESTER

(75) Inventors: George A. Blay; Ricardo E. Borjas, both of Corpus Christi, TX (US)

(73) Assignee: Celanese International Corporation, Dallas, TX (US)

( * ) Notice: Subject to any disclaimer, the term of this patent is extended or adjusted under 35 U.S.C. 154(b) by 0 days.

(21) Appl. No.: 09/244,953

(22) Filed: Feb. 4, 1999

(51) Int. Cl.[7] ..... C25B 3/00; C25D 21/06; C25D 21/18

(52) U.S. Cl. ..... 205/455; 205/99; 205/101; 205/98

(58) Field of Search ..... 205/455, 98, 99, 205/101

(56) References Cited

U.S. PATENT DOCUMENTS

| | | | | |
|---|---|---|---|---|
| 3,769,329 | | 10/1973 | Paulik et al. | 260/488 |
| 4,990,227 | * | 2/1991 | Steiniger et al. | 204/59 R |
| 5,001,259 | | 3/1991 | Smith et al. | 562/519 |
| 5,026,908 | | 6/1991 | Smith et al. | 562/519 |
| 5,144,068 | | 9/1992 | Smith et al. | 562/519 |
| 5,371,286 | | 12/1994 | Blay et al. | 562/519 |
| 5,374,774 | | 12/1994 | Ochiai | 562/519 |
| 5,625,095 | | 4/1997 | Miura et al. | 562/519 |
| 5,723,660 | | 3/1998 | Morimoto et al. | 562/519 |
| 5,783,731 | | 7/1998 | Fisher et al. | 562/519 |

FOREIGN PATENT DOCUMENTS

| | | |
|---|---|---|
| 0 752 406 A1 | 4/1996 | (EP) . |
| 55-54583 | 4/1980 | (JP) . |
| 98/17619 | 4/1998 | (WO) . |

OTHER PUBLICATIONS

Okimoto et al., "Electrochemical Transformation of Aldehydes into Methyl Carboxylates and Nitriles", J. Org. Chem., vol. 53, pp. 218–219, 1988, no month available.*

Chiba et al., 1992, Bull. Chem. Soc. Jpn. 55: 335–36, no month available.

Okimoto and Chiba, 1988, J. Org. Chem 53: 218–19, no month available.

Shono et al., 1985. J. Org. Chem. 50: 4967–4969, no month available.

Kelsall et al., 1993, J. Electroanal. Chem. 361: 13–24, no month available.

* cited by examiner

*Primary Examiner*—Edna Wong
(74) *Attorney, Agent, or Firm*—M. Susan Spiering

(57) ABSTRACT

A process for electrochemical oxidation of aldehydes to esters is provided. The invention includes electrooxidation at a pH where an intermediate hemiacetal is favored, thereby providing for maximum selectivity to the desired ester and for maximum reaction efficiency. In particular, the invention provides for the electrooxidation of acetaldehyde to methyl acetate. The invention is illustrated with reference reactants native to the carbonylation process for the manufacture of acetic acid. Processes described herein are readily adapted to an industrial scale, particularly for the removal of acetaldehyde from process streams.

7 Claims, 1 Drawing Sheet

PROCESS FOR ELECTROCHEMICAL OXIDATION OF AN ALDEHYDE TO AN ESTER

BACKGROUND OF THE INVENTION

Aldehydes are among the most widely occurring compounds in nature and the chemical industry. Aldehydes are produced through a variety of chemical reactions, including, for example, oxidation of primary alcohols, ozonolysis of alkenes having at least one vinylic hydrogen, or partial reduction of certain esters (e.g., with DIBAH, diisobutylaluminum hydride). As a reactant, an aldehyde can be oxidized to yield a carboxylic acid or an ester through reversible nucleophilic addition of water or an alcohol. Nucleophilic addition of water to the carbonyl group initially yields a gem diol intermediate, while a hemiacetal intermediate is formed on the nucleophilic addition of an alcohol.

Aldehydes have become undesired byproducts of the chemical industry because of environmental regulations. In particular, regarding the present disclosure, methods of acetic acid manufacture produce undesired aldehydes in process streams. For example, methods of acetic acid manufacture, including those accomplished under high-water (e.g., see U.S. Pat. No. 3,769,329) or low-water (e.g., see U.S. Pat. No. 5,001,259) conditions, utilize the carbonylation reaction of methanol (MeOH) with carbon monoxide (CO). MeOH and CO are contacted with a catalyst solution: acetic acid, rhodium (Rh) complex, a promoter (methyl iodide, MeI), and a Rh catalyst stabilizer--lithium iodide (LiI). Byproducts of the overall reaction include hexyl iodide, carbon dioxide ($CO_2$), propionic acid, and aldehydes. An iridium catalyzed methanol carbonylation process is also described in EP 0752,406. Byproducts of the overall reaction differ slightly from the rhodium catalyzed carbonylation process. However, aldehyde impurities remain a concern. Aldehyde impurities of major concern include acetaldehyde (AcH), crotonaldehyde, and 2-ethylcrotonaldehyde. The latter two aldehyde impurities are each derived from AcH, and each appear to increase in amount as the amount of water decreases in the carbonylation reaction mixture (U.S. Pat. No. 5,723,660).

The present invention is not directed to any particular chemical process, or to the production of AcH by a particular route, but to the handling of the AcH byproduct. Accordingly, treatment or processing of AcH is important to this invention. Discussion of carbonylation processes is included to help exemplify the electrooxidation of the AcH invention.

Lowering concentrations of AcH in process streams would facilitate compliance with applicable environmental regulations. Furthermore, since other impurities--including propionic acid, crotonaldehyde, and 2-ethylcrotonaldehyde-are derived from AcH, lowering concentrations of AcH in process streams would also further the goal of lowering concentrations of these derivative impurities. While distillation may be used to remove AcH from process streams, exclusive use of distillation has disadvantages. The expense of building a distillation unit or tower that meets environmental regulations for containment of AcH is among the disadvantages.

A chemical process of addition of AcH with hydroxylamine sulfate has been tried as a method for removing AcH from process streams. However, the process led to many side reactions that created additional problems.

To develop processes for removing aldehydes, including AcH, from process streams, electrochemical oxidation of aldehydes to carboxylic acids or esters may be considered. For example, U.S. No. Pat. 4,450,055 (incorporated herein by reference) describes an electrochemical process involving partial oxidation of ethane to AcH, some of which is further oxidized to acetic acid.

Electro oxidation reactions have been reported for the electrosynthesis of methyl ester (RCOOMe) from aldehyde (RCHO) in divided cells. One electro oxidation reaction is carried out in the presence of MeOH and sodium cyanide (NaCN):

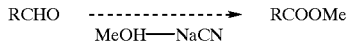

Precent yield of esters, based on aldehyde oxidized, has been reported to be between 48% to 83% for various substituted benzylaldehydes, 38% for octyl aldehyde, and roughly 44% for butyraldehyde (Chiba et al., 1982, Bull. Chem. Soc. Jpn. 55: 335–36). Another electro oxidation reaction is carried out in the presence of sodium methoxide (NaOMe), MeOH, and potassium iodide (KI):

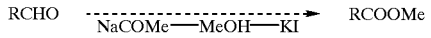

Percent yield of esters, based on aldehyde oxidized, has been reported to be between 68% for 2,2-dimethyl-3-hydroxypropionaldehyde to 91% for 4-nitrobenzaldehyde (Okimoto and Chiba, 1988, J. Org. Chem 53: 218–19).

Shono et al. have noted electrochemical oxidation of aldehydes to esters in the presence of MeOH or butanol containing KI or KBr in undivided cells (Shono et al., 1985. J. Org. Chem. 50: 4967–4969). Using MeOH as the reactant alcohol, the present inventors repeated the unbuffered process of Shono et al. as described herein in Example 1 and found it to be unworkable for lower chain alkyl aldehydes. When AcH was used as the aldehyde substrate, the inventors recovered primarily ethanol (EtOH), acetic acid, and MeI from the AcH-MeOH-KI reaction mixture, not the ester methyl acetate (MeOAc). However, when aldehydes containing five or more carbon atoms (such as valeraldehyde, hexanal, and decyl aldehyde) were used as substrates, the expected methyl esters were recovered using the unbuffered process of Shono et al.

Published Japanese Application No.: Sho 55–54583 (Shono) (disclosed Apr. 21, 1980) also has noted the electro oxidation of aldehydes in the presence of alcohol and iodide as a method for manufacture of various esters. This publication reportedly provides for dripping a solution of hexanal, n-butanol, and n-hexane into an aqueous solution of concentrated KI (1 mole KI per liter). This process is not adaptable to an industrial scale.

The present inventors provide herein an improved process for electro oxidation of an aldehyde to an ester. The process is readily adapted to an industrial scale.

| Abbreviations | |
|---|---|
| AcH | Acetaldehyde |
| amu | atomic mass unit |
| $CHI_3$ | Iodoform |
| CO | Carbon Monoxide |
| $CO_2$ | Carbon Dioxide |
| 1,1'-DME | 1,1'-Dimethoxyethane |
| EtI | Ethyl Iodide |

-continued

| Abbreviations | |
|---|---|
| EtOH | Ethanol |
| GC | Gas Chromatography |
| HCHO | Formaldehyde |
| HI | Hydriodic Acid |
| HPLC | High Pressure Liquid Chromatography |
| KI | Potassium Iodide |
| Li | Lithium |
| LiI | Lithium Iodide |
| $LiIO_3$ | Lithium Iodate |
| LiOAc | Lithium Acetate |
| mA | milliamperes |
| MeI | Methyl Iodide |
| MeOAc | Methyl Acetate |
| MeOH | Methanol |
| MS | Mass Spectroscopy |
| % Covers. | Percent Conversion |
| % R.E. | Percent Relative Efficiency |
| NaCN | Sodium Cyanide |
| NaOMe | Sodium Methoxide |
| RCHO | Aldehyde |
| RCOOMe | Methyl Ester |
| Rh | Rhodium |
| Wt. % | Weight percent |

SUMMARY OF THE INVENTION

The present invention provides a process for electrochemical oxidation of an aldehyde moiety of a target chemical to an ester moiety. Electrooxidation may be carried out in either the anolyte of a divided electrochemical cell or the electrolyte of an undivided electrochemical cell. In either configuration, the reaction solution is buffered to a pH at about which the intermediate hemiacetal is favored for subsequent formation of the ester as opposed to conversion of the hemiacetal to an acetal. Further, in either configuration, water may be added to the anolyte or electrolyte. Alternatively, essentially pure alcohol, such as MeOH, may be used as an anolyte or electrolyte solvent. Embodiments of the present invention include process for commercial-scale electro oxidation of aldehydes.

Therefore, an embodiment of the present invention provides a process for oxidizing an aldehyde moiety of a target chemical to an ester moiety in a divided electrochemical cell, the process having a hemiacetal intermediate. The process comprises preparing an anolyte comprising (i) combining an alcohol, a source of halide, a buffering agent, and water to form an electrolyte, (ii) adjusting the electrolyte to a pH at about which the hemiacetal is favored over acetal formation, and (iii) adding the target chemical; placing the anolyte in contact with an anodic electrode of the divided cell; placing a catholyte in contact with a cathodic electrode of the divided cell; and applying electrical power to the cell.

A process for oxidizing an aldehyde moiety of a target chemical to an ester moiety in an undivided electrochemical cell, the process having a hemiacetal intermediate is a further embodiment of the present invention. The process comprises preparing an electrolyte comprising an alcohol, a source of halide, a buffering agent, water, and the target chemical; adjusting the electrolyte to a pH at about which the hemiacetal is favored over acetal formation; placing the electrolyte in contact with an anodic electrode and with a cathodic electrode of the undivided cell; and applying electrical power to the cell.

In the divided cell and the undivided cell embodiments of the present invention, the electrical power has an amperage or voltage sufficient to oxidize the aldehyde moiety to the ester moiety, and the applying is for a time period sufficient to oxidize the aldehyde moiety to the ester moiety. A variation of these processes excludes the addition of water and, in that case, the pH is referred to as apparent pH as defined infra. An even further embodiment of each of these processes comprises monitoring pH during the applying step where electrochemical oxidation occurs and further adjusting pH of the anolyte or electrolyte in response to the monitoring.

In a preferred embodiment, the present invention advantageously may be used to oxidize lower chain aldehydes such as AcH or HCHO to esters such as MeOAc or methyl formate, respectively. In a further embodiment, it also advantageously may be carried out using reactants native only to the carbonylation process used in the manufacture of acetic acid. In this context, use of the present invention for the removal of AcH from process streams generated during acetic acid manufacture is particularly desirable. Using an embodiment of the present invention, AcH may be electrooxidized to MeOAc without generating additional impurities of similar environmental concern. MeOAc, which is subject to less stringent environmental regulations than AcH, may be removed or recycled into the carbonylation process for the further synthesis of acetic acid.

In another embodiment, the present invention provides a process for oxidizing AcH to MeOAc in a divided electrochemical cell, comprising preparing an anolyte comprising (i) combining MeOH, LiI, lithium acetate (LiOAc), and water to form an electrolyte, (ii) adjusting the electrolyte to a pH of between pH 5.2 and pH 6.1, and (iii) adding AcH; placing the anolyte in contact with an anodic electrode of the divided cell; placing a catholyte in contact with a cathodic electrode of the divided cell; and applying electrical power to the cell.

A process for oxidizing AcH to MeOAc in an undivided electrochemical cell is another embodiment of the invention. The process comprises preparing an electrolyte comprising MeOH, lithium halide, LiOAc, AcH, and water; adjusting the electrolyte to a pH of between about pH 5 and pH 6.5; placing the electrolyte in contact with an anodic electrode and with a cathodic electrode of the undivided cell; and applying electrical power to the cell. In each of these embodiments, the electrical power has an amperage or voltage sufficient to oxidize AcH to MeOAc, and the applying is for a time period sufficient to oxidize AcH to MeOAc. A variation of these processes excludes the addition of water and, in that case, the pH is referred to as apparent pH as defined infra. An even further embodiment of each of these processes comprises to monitoring pH during the applying step where electrochemical oxidation occurs and further adjusting pH of the anolyte or electrolyte in response to the monitoring.

A process for lowering AcH concentration in a process stream from acetic acid manufacture having a carbonylation cycle, and returning an AcH-lowered product process stream to the carbonylation cycle, the process having a hemiacetal intermediate and using a divided electrochemical cell is a further aspect of the present invention. The process comprises preparing an anolyte comprising (i) combining an alcohol, a source of halide, a buffering agent, and water to form an electrolyte, (ii) adjusting the electrolyte to a pH at about which the hemiacetal is favored over acetal formation, and (iii) adding the process stream from acetic acid manufacture; placing the anolyte in contact with an anodic electrode of the divided cell; placing a catholyte in contact with a cathodic electrode of the divided cell; applying electrical power to the cell to form an AcH-lowered process stream; and returning the AcH-lowered process stream to the carbonylation cycle.

Processes provided by the present invention demonstrate a greater degree of selectivity for the desired product and a greater reaction efficiency than have been available heretofore.

DETAILED DESCRIPTION OF THE PREFERRED EMBODIMENTS

Figure 1:
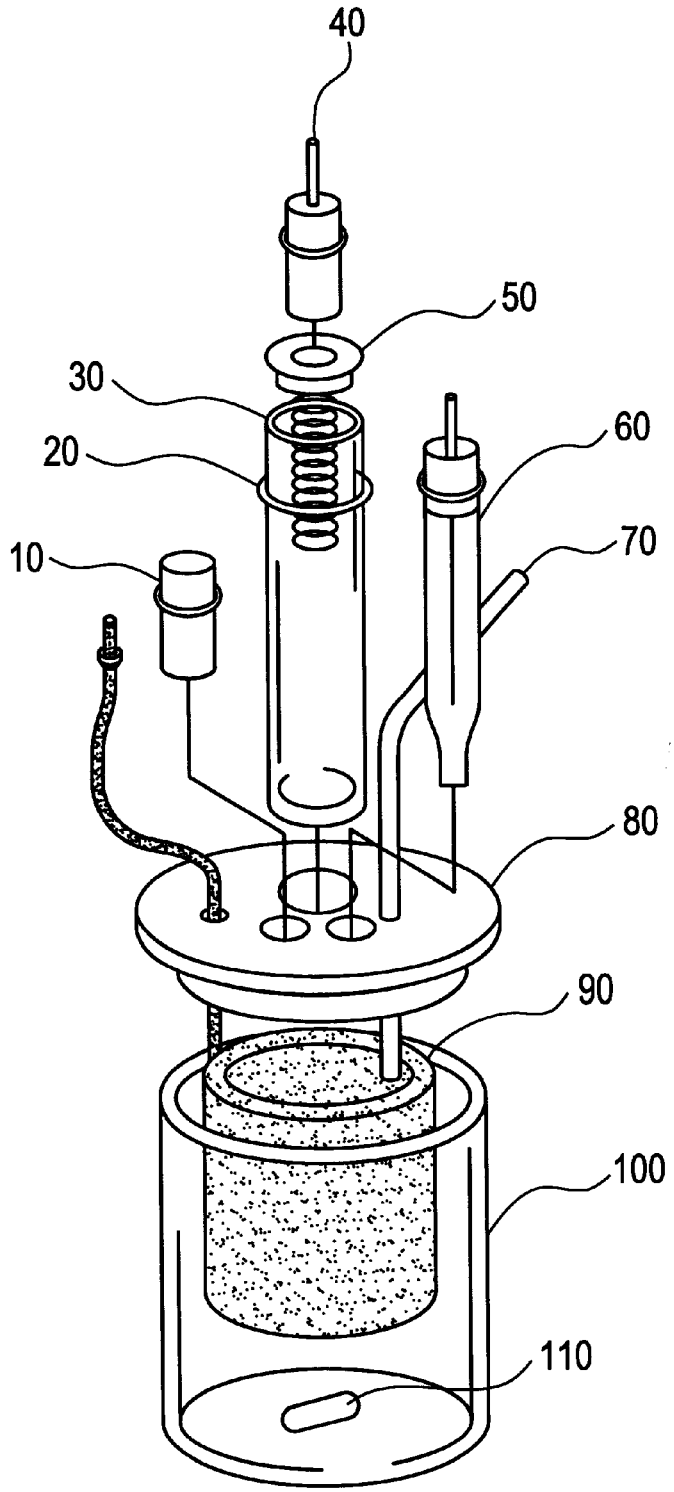
FIG. 1 is a depiction of a divided electrochemical cell.

In one embodiment of the present invention, electro oxidation of AcH as the target chemical is accomplished in order to provide a process for removal of AcH from process streams generated during acetic acid manufacture. The MeOAc that is recovered from electro oxidation of AcH may be recycled back into the reaction that produced it, for example, it may be recycled into the carbonylation process of acetic acid manufacture. The MeOAc may also be removed by distillation without being recycled. Since MeOAc is subject to less stringent environmental regulation than AcH, distillation to remove MeOAc from process streams raises fewer environmental concerns than distillation to remove AcH.

In another embodiment of the present invention, only chemicals native to the carbonylation process for the manufacture of acetic acid are utilized in the reaction solution used for the electro oxidation of AcH to MeOAc. The solvent medium used is a mixture of MeOH and water wherein the MeOH:water ratio (v/v) is 1:1. The mixture is buffered with LiOAc, and it is adjusted to a pH of between about 5.2 and 6.1. LiOAc and LiI are also added to provide ions to the anolyte and/or electrolyte.

In an embodiment of the present invention that utilizes an electrochemical cell of a divided configuration, AcH is maintained in the anolyte, but not the catholyte, so that, while AcH may be oxidized to MeOAc at the anodic electrode, it is not reduced to EtOH at the cathodic electrode. The working electrode, the anodic electrode, is a reticulated graphite electrode. The counter electrode, the cathodic electrode, is a platinum coil electrode. In a further embodiment, the starting concentration of AcH in the anolyte is about 0.5 wt. %–1.0 wt. %.

In an embodiment of a continuous flow process, the rate of feed is controlled so that incoming AcH concentration is about 0.5 wt. %–1.0 wt. %. Electro oxidation of AcH in reaction mixtures that contain AcH at concentrations significantly above this level may lead to the formation of iodoform ($CHI_3$) via the haloform reaction. In a further embodiment, the use of MeOH (without the addition of water) as the anolyte solvent minimizes the occurrence of the haloform reaction. In further embodiments utilizing divided cell configurations, conditions are obtained wherein passivation of the anodic electrode with lithium iodate ($LiIO_3$), as well as formation of $CHI_3$, are minimized.

In an embodiment utilizing an undivided cell configuration, conditions are obtained for the conversion of substantially all AcH to MeOAc and EtOH.

In a preferred embodiment of the present invention, the overall reaction of AcH (i.e., $H_3C$—CHO) and MeOH (i.e., $CH_3OH$) (in the presence of iodide) to form MeOAc (i.e., $H_3C$—$COOCH_3$) is represented as follows:

$$H_3C\text{—}CHO + CH_3OH + I^+ \dashrightarrow H_3C\text{—}COOCH_3 + 2\,H^+ + I^- \quad (1)$$

The reaction proceeds by mixing AcH and MeOH with an iodide salt and applying electric power. Iodide serves as both a supporting electrolyte and as a mediator.

The present invention includes conditions in undivided cells for conversion of substantially all AcH to MeOAc and EtOH. In divided cells, the present invention includes conditions for converting substantially all AcH to MeOAc while avoiding formation of EtOH as a byproduct. In a preferred embodiment, components native to the carbonylation process that is a basis for the manufacture of acetic acid are utilized in electrochemical oxidation of AcH to MeOAc. Consequently, the removal of AcH from process streams generated in the manufacture of acetic acid may be facilitated in divided cells without the generation of additional process stream components.

Process streams (e.g., see U.S. Pat.s Nos. 5,371,286; 5,374,774; and 5,783,731) of systems for manufacturing acetic acid that make use of the carbonylation reaction (e.g., see U.S. Pat. Nos. 3,769,329; 5,001,259; 5,026,908; 5,144,068) provide exemplary starting material containing undesired aldehydes (see U.S. Pat.s Nos. 5,625,095; 5,723,660; and PCT publication WO 98/17619) for the present invention (each of the cited patents and the PCT publication is incorporated herein by reference). The undesired aldehydes of such process streams include AcH, crotonaldehyde, 2-ethyl-crotonaldehyde, butyraldehyde, and 2-ethylbutyraldehyde (WO 98/17619). Another source of starting material is a process stream generated in the production of vinyl acetate from ethylene and acetic acid. Such a process stream may also include AcH, crotonaldehyde, 2-ethyl-crotonaldehyde, and butyraldehyde (U.S. Pat. No. 5,625,095).

From a perspective of chemical manufacture, distillation of process streams may be utilized in conjunction with the present invention to remove aldehyde impurities. In such a context, process streams resulting after one or more distillations are also possible sources of aldehydes to be electrooxidized according to the present invention.

Percent Conversion and Percent Reaction Efficienc. Percent conversion ("% Conversion" or "% conver.") is defined herein as:

$$\%\ \text{Conversion} = \left(1 - \frac{[\text{Aldehyde}]\ \text{at}\ t = x}{[\text{Aldehyde}]\ \text{at}\ t = 0}\right) \times 100,$$

where

[Aldehyde] equals the concentration of the chemical containing an aldehyde moiety in the electrolysis solution at times t=0 and t=x.

Percent reaction efficiency (% R.E.) for MeOAc is defined herein as:

$$\%\ R.E. = \frac{\eta_{MeOAc}}{\eta_{AcH\ at\ t=0} - \eta_{AcH\ at\ t=x}} \times 100,$$

where $\eta_{_MeOAc_}$ represents number of moles of MeOAc at time t=x, and where $\eta_{_AcH\ at\ t=0}$ and $\eta_{_AcH\ at\ t=x}$ represent number of moles of AcH at times t=0 and t=x, respectively. In the definition of % R.E for EtOH, $\eta_{13\ EtOH}$ would replace $\eta_{_MeOAc}$ in the numerator of the above equation, where $\eta_{EtOH}$ represents number of moles of EtOH at time t=x.

Gas chromatography (GC) area values for MeOAc, EtOH, AcH, and acetic acid were used to estimate concentrations of these chemicals, which were also reported in weight percent (wt. %) values. Since GC area values are estimated concentrations, they were also used to estimate % conversion values as well as numbers of moles for % R.E values.

Sources of aldehyde. Any feed containing a target chemical having an aldehyde moiety can be used as a source of aldehyde, as long as components of the feed are not electrochemically active. The target chemical may be represented as RCHO, and the R group of the target chemical may be H (hydrogen), alkyl, alkenyl, alkynyl, or an aryl group, or a derivative of such nonhydrogen substituents. When the alkenyl has a double bond at a terminal carbon, then the process is for a divided cell so that polymerization is avoided at the electrode. In general, an aldehyde moiety of any such target chemical may be electrochemically oxidized to an ester moiety using the present invention. In particular, AcH and HCHO (for which the R groups are $CH_3$ and H, respectively) are preferred target chemicals. Further preferred aldehydes include crotonaldehyde and 2-ethylcrotonaldehyde. Preferred feed materials containing aldehydes include process streams from acetic acid manufacture. Process streams containing about 1%, 5%, 10%, or even up to 50% aldehyde, may be utilized as feed materials, with appropriate dilution. Other preferred feed materials containing aldehydes include for example process streams from vinyl acetate manufacture. Preferably, feed process streams are diluted so that the concentration of aldehyde is optimal for reaction selectivity and efficiency, for example, to about 0.5–1.0 wt % for AcH.

Either lower chain alkyl, alkenyl, or alkynyl aldehydes, such as those containing one to four carbon atoms (e.g., formaldehyde, acetaldehyde, propionaldehyde, butyraldehyde, or crotonaldehyde) in toto or in the aldehyde's main chain (e.g., 2-ethyl-crotonaldehyde or 2-ethylbutyraldehyde), or longer chain alkyl, alkenyl, alkynyl, or aryl aldehydes, such as those containing five or more carbon atoms in the aldehyde's main chain (e.g., valeraldehyde, hexanal, heptaldehyde, or octanal) or in an aryl group (benzylaldehyde or 4-ethyl-benzaldehyde), may be removed from mixtures through oxidation to esters. Again, an aldehyde moiety of almost any chemical may be oxidized to an ester moiety.

Scale and Cells. An electrochemical cell as provided in the drawing may be used in embodiments of the present invention. However, in light of the present disclosure, those of skill in the art will also appreciate that process disclosed for the present invention may be used on a scale commensurate with the manufacture of chemicals, like acetic acid, where production volumes of thirty or more liters per minute are common. Embodiments of the present invention include structures of sizes encountered in systems of industrial chemical production, for example, configurations wherein a target chemical (i.e., a chemical having an aldehyde moiety) is added at reaction initiation to batch solutions, or continuously to an electro oxidation reaction stream, at rates of tens of liters per minute. An example of a large scale electro oxidation cell is the EC Electro MP-Cell (ElectroCell AB, T äby, Sweden). Furthermore, embodiments of the present invention include structures in which a target chemical is added at much lower rates, including embodiments that operate on a scale of microfluidic systems.

Divided cells are preferred when a reaction occurring at the opposite electrode is undesirable. Undivided cells are preferred when side reactions are minimized or are acceptable.

Electrodes. Almost any type or size of electrode can be used for cells in an undivided or a divided configuration. The electrode must be stable upon electro oxidation and must be effective for the scale of the cell. For purposes of illustration, cobalt oxide, graphite, lead dioxide, manganese oxide, nickel oxide, and platinum are commonly used materials for anodic electrodes; copper, graphite, lead, lead alloys, platinum, and zinc are commonly used materials for cathodic electrodes. Gold may also be used as an electrode material. A reticulated vitreous carbon electrode is a preferred working electrode.

Multiple variations in arrangements of anodic and cathodic electrodes are also included within the scope of the present invention. In one embodiment, one or more anodic electrodes of an electro oxidation unit are placed within a stream of anolyte or electrolyte, or within a batch solution of the same. An electric-power-conducting stream conduit or batch vessel itself may serve as an anodic electrode or a cathodic electrode. Similarly, in one embodiment, one or more cathodic electrodes of an electro oxidation unit are placed within a catholyte. Additional reference and/or monitoring electrodes may be present in certain embodiments as well.

Membranes Separating Anolyte and Catholyte. A glass frit is used to separate anolyte from catholyte in one embodiment. Other suitable membrane materials include various types of perfluorinated ionomer containing about 5 to 15% sulfonic acid or carboxylic ionic functional groups (e.g., Nafion® membranes) or polytetrafluoroethylene (PTFE, e.g., Teflon® membranes) or a polypropylene material (e.g., Celgardg® membranes). These membrane materials are noted by way of illustration and not limitation. Materials permeable to ions, but largely impermeable to reactants and products, are used for membranes of "divided electrochemical cells." As for cells and electrodes, embodiments of the present invention include membranes ranging in size from microdimensions to dimensions needed in industrial systems for removal of aldehyde via electro oxidation.

Buffers and Adjustment of pH. The present invention provides conditions wherein the reaction solution is buffered to a pH so that conversion of an aldehyde to an intermediate hemiacetal, and then to an ester, is favored, over its conversion from a hemiacetal to an acetal. In this light, the desired pH of the reaction is one where the intermediate hemiacetal is favored in the aldehyde-hemiacetal-acetal equilibrium.

Acceptable pH ranges may vary one to two or more pH units from the desired pH.

Reaction selectivity and efficiency diminishes with pH values furthest from the desired pH.

Accordingly, a desirable buffering agent has a pKa close to the desired pH where the hemiacetal is most stable.

Preferably, the electrolyte pH is adjusted to a pH of between about pH 4 and pH 9, more preferably, between about pH 5 and pH 6.5 and, even more preferably, between about pH 5.2 and pH 6.1. Most preferably, the pH is about 5.27 for electro oxidation of HCHO or $CH_3CHO$.

Further embodiments of the present invention include other buffers for stabilizing anolyte or electrolyte pH, as well as other acids or bases for adjusting pH, as long as the buffers, acids, or bases are not electrochemically incompatible with the electro oxidation of the aldehyde moiety of the target chemical. By way of illustration, acetate, phosphate, borate, citrate or phthalate buffers that have a pKa between about pH 4 and pH 6 or even about pH 8, that are soluble in alcohol or alcohol-water mixtures, and that are not significantly polymerized, are buffers that may be used to prepare anolyte or electrolyte. By way of further illustration, a range of conventional (or Lewis) acids and bases are used to adjust the pH of anolyte or electrolyte.

Selectivity and reaction efficiency are sacrificed at the outer ranges of pH, for example, aldol condensation reactions occur at pH values greater than about 9.

In a further embodiment, a hydrated glass electrochemical probe is used to measure the pH of anolyte or electrolyte. Measurements of pH are accomplished using such hydrated glass probes or through use of other pH measuring devices, including, for example, titration methods of quantitative chemistry. For illustration, other embodiments would include systems for continuous monitoring or measuring of the pH of anolyte or electrolyte streams, or, in the case of batch solutions, continuously or at discrete incremental intervals, using hydrated glass probes, pH indicator papers, or other means for determining pH. "Apparent pH" refers to the measurement of pH in embodiments of the present invention that contain primarily solvent hydrocarbons, particularly alcohols such as methanol, and very little water. While measurements of pH in such embodiments may be accomplished using an electrode, the pH readings generally lack stability with time. It is generally necessary therefore to take such "apparent pH" reading shortly after inserting the electrode into the electrolyte or anolyte. An indication that an apparent pH reading is inaccurate is if the reading drifts or is erratic.

Alcohols and Ester Moieties. As used herein an "alcohol" is a hydrocarbon having a molecular structure ROH and the alcohol is primary, secondary or tertiary moiety. Preferably, the alcohol is soluble in the anolyte or electrolyte. R is a saturated or unsaturated, substituted or unsubstituted aliphatic or cycloaliphatic chain, a substituted or unsubstituted aryl group, optionally containing one or more hetero atoms such as nitrogen, oxygen, phosphorus or sulfur.

Preferably, the alcohol is MeOH. In the present invention, the reactant alcohol is the source of the ester moiety. Preferably, the product ester is soluble in the anolyte/electrolyte. The formation of an ester moiety is determined using, for example, GC/MS.

Source of halide. The halide is a promoter or catalyst for the reaction. Preferably, the halide is a salt to improve the conductivity of the electrolyte or anolyte. Preferred halides are chloride, bromide, or iodide, with iodide being more preferred. Sources of halide include salts of lithium, sodium, potassium, rubidium, and cesium, as well as salts of magnesium, calcium, strontium, barium, cobalt, antimony, zinc, tin, iron, lanthanum, nickel, and manganese. Lithium iodide or alkyl iodides such as methyl iodide are most preferred. Other sources of iodide include those of Table V in U.S. Pat. No. 5,001,259.

The halide may also be provided by organic halides. Suitable halide providing components may be selected from the following list of halogen containing compounds: RX, where R=any alkyl, alkenyl, alkynyl, or aryl group (including those containing hetero atoms) and X=Cl, Br, or I. MeI or EtI are noted by way of illustration as being organic halide sources of iodide. All sources of halogen, organic and non-organic, noted in U.S. Pat. No. 3,769,329 are also sources of halide. Other sources of halide include ammonium and alkyl ammonium salts of halides, such as tetraalkylammonium iodides.

The present inventors provide herein reaction conditions where LiI is used at about 0.011 mole/100 ml, an amount that did not allow depletion of iodide during the reaction. The Shono published application cited herein uses a 1 M solution of KI salt, a concentration that, when combined with the dripping method of the Shono published application, is incompatible with an industrial scale. Salts of iodide, bromide, and chloride other than lithium salts—e.g., sodium, potassium, or cesium salts—are used as sources of halide in other embodiments. In other embodiments, ions that are counter to a halide ion when the halide is in salt form consist of more than one atom, but must be compatible with the electrochemical oxidation of an aldehyde moiety.

Catholyte. The catholyte must allow current transport and must be conductive. It does not significantly contribute to side reactions. In a preferred embodiment, catholyte is prepared by dissolving about 3.0 g LiI and about 3.5 g LiOAc in about 200 ml 1:1 (v/v) MeOH:water. In other embodiments, catholyte is prepared using a variety of the previously-noted electrolytes.

For other embodiments, by way of illustration, fluoride salts, acetic acid, chloride salts, formate salts including sodium and lithium formate, perchlorate, or sulfate salts are utilized to prepare catholyte. The catholyte solvent may be water-based, contain alcohol, or be made using only an alcohol as the catholyte solvent. When water is not added, sodium perchlorate or lithium chloride is preferred for the catholyte. Perchlorate is not used when the cell is undivided.

Electrical Power. In embodiments using a divided cell similar to the one depicted in the drawing, electric power was generated from a HEWLETT PACKARD HP-6205B dual power supply. Other embodiments employ power supplies commensurate with the scale of the electro oxidation. Electrical power (galvanostatic current and/or potentiostatic voltage) must be sufficient to drive the electrochemical oxidation of an aldehyde moiety to an ester moiety.

Voltage of, for example, 2 volts for undivided cells, or 5–10 volts, or even 15 volts for divided cells may be used. Current may be from about 300 mA to about 500 mA, for example, or greater, especially for commercial scale operations or for systems lacking added water. The electrical power may be adjusted depending upon the composition of the products.

Control and Monitoring of Reaction Temperature. Temperature of the electro oxidation reaction for embodiments of the present invention is maintained using a variety of temperature control and monitoring equipment. For example, in some embodiments, various thermocouple devices, or simply mercury or alcohol thermometers, are used to monitor temperature. The size/scale of equipment used for temperature control and monitoring can vary with the size/scale of the electro oxidation system. In one embodiment, the temperature of the solution in which electro oxidation of aldehydes took place was controlled by placing the reaction unit in a water bath to which ice was added. Reaction temperature was maintained within a range from about 12° C. to about 30° C. and was monitored with a FLUKE 52 thermocouple apparatus. In another embodiment, temperature of the electro oxidation solution was maintained using a refrigerated circulator. In these embodiments, the temperature of the electro oxidation solution is maintained within the range of the freezing and boiling points of the electro oxidation solution using such equipment. However, due to the dilute concentration of aldehyde, and the fact that vapors are trapped, it is possible for the temperature of the reaction to exceed the boiling point of the aldehyde. For example, while the boiling point of AcH is 20.2° C., the present inventors have observed a successful conversion where the temperature of the electro oxidation solution climbed to 30° C. near the end of the reaction. In embodiments using MeOH solutions or MeOH:water-based solutions containing AcH, the electro oxidation solution is maintained between 10° C. and 30° C., or more preferably, between 20° C. and 25° C., using such equipment.

Recycling. In a preferred embodiment related to acetic acid manufacture using a carbonylation process, reaction products of the process of the present invention are recycled to a carbonylation unit.

The following examples are included to demonstrate preferred embodiments of the invention. It should be appreciated by those of skill in the art that the techniques disclosed in the examples which follow represent techniques discovered by the inventor to function well in the practice of the invention, and thus can be considered to constitute preferred modes for its practice. However, those of skill in the art should, in light of the present disclosure, appreciate that many changes can be made in the specific embodiments which are disclosed and still obtain a like or similar result without departing from the spirit and scope of the invention. All quantitative values are expressed as approximate amounts within scientific limitations.

EXAMPLES

Example 1

Electro oxidation of Aldehydes in Undivided Cells

The present example provides studies conducted, in undivided cells so that substantially all AcH is converted to EtOH or MeOAc. An undivided cell has no physical separation of anolyte and catholyte, and therefore, the substrate for electro oxidation is in contact with anodic electrode and cathodic electrode. Such a configuration may be considered to be more energy efficient than the configuration represented by a divided cell, in which anolyte and catholyte are physically separated.

Unbuffered Conditions. An electrolysis solution of 5 wt. % AcH [5 g per 100 g, or 1.135 moles per kilogram] and 0.29 wt. % LiI [0.29 g per 100 g, or 0.022 moles per kilogram] in reagant-grade MeOH was prepared. The apparent pH of the electrolysis solution was about 4.7.

For electrolysis, a 100 ml solution was transferred to a 150 ml cell. The undivided cell was similar in its scale and constituent parts to the divided cell depicted in the drawing, except that it did not have an auxiliary electrode chamber.

In order to stir the electrolysis solution, a magnetic stir bar was placed in the solution and a stir plate with a magnetic element was used to spin the magnetic stir bar continuously. The power supply used to apply current to the electrodes in electrolysis solution was a HEWLETT PACKARD HP-6205B dual power supply. A current of about 300 mA was applied for up to 24 hours.

During electrolysis, cells were placed in a cooling system—either a large container filled with water and ice or a FISHER SCIENTIFIC Model 9100 refrigerated circulator. The target or set temperature range was 20° C. to 25 ° C. Temperature was monitored with a FLUKE 52 thermocouple apparatus, and ice was added when temperature began marginally to increase above 25° C. The temperature range under which electrolysis was carried out was about 17° C. to 30° C.

The solution components were identified though retention-time analysis after GC/MS. GC was performed with an HEWLETT PACKARD HP-5890 gas chromatograph equipped with a flame ionization detector and a RESTEK STABILWAX DA capillary column. Elution was programmed to temperature (i.e., a ramp of 40° C. to 230° C. at a program rate of 8° C. per minute). Helium was used for the carrier gas, and external standards were used for calibration. Unknowns were identified with the use of known standards in GC/MS.

Results for Unbuffered Conditions. Data for percent conversion from AcH (% conver.) and MeOAc percent reaction efficiencies (%R.E.) following electrolysis of AcH-containing electrolysis solution for time periods of up to 24 hours are presented in Table 1. Corresponding data for acetic acid content during electrolysis under unbuffered conditions in the undivided cell are presented in Table 2. While about 24 hours was required for conversion of more than 94% of the AcH (Table 1) in the unbuffered electrolysis solution, conversion to acetic acid decreased appreciably after 7 hours (Table 2).

The apparent pH at the end of electrolysis had become more acidic; it had lowered to 2.7. Byproducts from side reactions were identified to include 1,1'-dimethoxyethane (1,1'-DME), AcH-trimer (a trioxane derivative), ethanol (EtOH), acetic acid, MeI, and ethyl iodide (EtI).

TABLE 1

Percent Conversion and Methyl Acetate Percent Reaction Efficiency for Unbuffered Electrolysis Solution in an Undivided Cell.

| TIME | AcH-AREA | MeOAc-AREA | AcH RATIO | % CONVER | AcH-DIFF. | % R.E. |
|---|---|---|---|---|---|---|
| 0.00 | 296534 | 0 | 1.000 | 0.00 | 0 | |
| 1.50 | 273719 | 16619 | 0.923 | 7.69 | 22815 | 43.34 |
| 3.25 | 221866 | 26325 | 0.748 | 25.18 | 74668 | 20.98 |
| 4.50 | 217987 | 35341 | 0.735 | 26.49 | 78547 | 26.77 |
| 6.50 | 185660 | 37790 | 0.626 | 37.39 | 110874 | 20.28 |
| 7.75 | 160679 | 41661 | 0.542 | 45.81 | 135855 | 18.25 |
| 8.75 | 125704 | 43578 | 0.424 | 57.61 | 170830 | 15.18 |
| 24.00 | 16576 | 123348 | 0.056 | 94.41 | 279958 | 26.22 |

In all tables, TIME values are in hour units. In Tables 1, 6, and 7, AcH-AREA and MeOAc-AREA values are GC area values for AcH and MeOAc, respectively, at a given time t. In Tables 1,3,4, 6,7,9,11, and 13, AcH RATIO values are values for the ratio of AcH-AREA at t=x over AcH-AREA at t=0, and AcH-DIFF values are values for the difference between AcH-AREA at t=0 minus AcH-AREA at t=x; % CONVER. and % R.E. are as previously defined.

TABLE 2

Acetic Acid Content as Area Counts During Electrolysis for Unbuffered Electrolysis Solution in an Undivided Cell.

| TIME | Acetic Acid AREA |
|---|---|
| 0.00 | 0 |
| 1.50 | 10408 |
| 3.25 | 21997 |
| 4.50 | 39448 |
| 6.50 | 51831 |
| 7.75 | 61418 |
| 8.75 | 60631 |
| 24.00 | 54860 |

In Tables 2,8,10,12, and 14, Acetic Acid-AREA values are GC area values for acetic acid at a given time t. Again, in all tables, TIME values are in hour units.

The current applied in these byproduct-formation experiments averaged about 350 mA.

A control experiment was performed in which a solution of MeOH and AcH was monitored at room temperature for a few days. A very small amount of acetal was found to have formed. However, acetal was found to form almost immediately when a drop of concentrated hydrochloric acid was added to the same solution.

No hydrocarbons like ethane were detected dissolved in the unbuffered solution (pH<5) of the undivided cell after electrolysis.

Electrolysis was carried out using a platinum coil cathode and a reticulated carbon anode, and, in order to promote the formation of hydrocarbons like ethane by reduction of AcH, a catalytic electrode, such as one made of cadmium, is suggested.

Buffered Conditions. When alkyl aldehydes containing five to ten carbons in toto were used as substrates under unbuffered conditions, methyl esters were generated. However, when lower chain alkyl aldehydes were used as substrates under unbuffered conditions, the generation of methyl esters was not robust and was accompanied by the formation of many byproducts. In view of unsatisfactory selectivity in the unbuffered electrolysis solutions at low pH, studies of electrolysis solutions of pH 5 to 12 in undivided cells were conducted.

Materials and methods for these studies were similar to those of the unbuffered studies. However, in addition to conducting studies in undivided cells using electrolysis solutions with pH values between 5 and 12, a current of about 500 mA, rather than about 300 mA or about 350 mA, was applied initially. Furthermore, to prevent swings in pH (e.g., through drift to lower pH values) during electrolysis in later studies, the electrolysis solution was buffered with LiOAc (a hard Lewis base) and the pH was adjusted to the desired value with acetic acid. For studies where the hemiacetal desired was an AcH hemiacetal, the pH of the electrolysis solution was buffered to about pH 5.27, reportedly favorable for AcH hemiacetal formation, using LiOAc and acetic acid. To obtain electrolysis solutions of pH greater than 10, pH was adjusted using methanolic lithium hydroxide.

Results Using Buffered Conditions. For electrolysis solutions having a pH between 5 and 8, formation of acetal yet occurred, but larger amounts of MeOAc were formed. For electrolysis solutions having a pH between 8 and 10.5, formation of acetal was minimized, but no improvement in formation of MeOAc was observed. $LiIO_3$ was observed to form and cause passivation of the electrode. For electrolysis solutions having a pH greater than about 10.5, condensation reactions predominated.

Drift to more acidic pH values still occurred in electrolysis solutions of all tested pH values, although it was minimal when the pH was approximately 10. In addition, $LiIO_3$ formation occurred when the pH was greater than 9. $LiIO_3$ formation also occurred when electrolysis exceeded 10 hours. The presence of LiOAc helped to lessen the formation of MeI.

For electrolysis solutions of pH greater than 5, the amount of HI was found to be diminished.

Consequently, halogenation of MeOH and EtOH was lessened.

Data for percent conversion (% conver.) from AcH and for MeOAc % R.E. are presented in Table 3 for electrolysis of AcH-containing electrolysis solution initially buffered to pH 5.27 for time periods of up to slightly more than 18 hours. Apparent pH of the electrolysis solution after slightly more than 18 hours of electrolysis was 5.8 1, and the white crystals of $LiIO_3$ formed toward the end of the 18 hours. Percent conversion from AcH was 99.57% after slightly more than 18 hours, when the MeOAc % R.E. reached an estimated maximum of 62.72% (Table 3). In addition to improvement in MeOAc % R.E., other major improvements associated with the use of electrolysis solution initially buffered to pH 5.27 were the elimination of EtI and the AcH trimer paraldehyde. MeI yet formed, but in very small amounts. However, as the data of Table 4 detail, EtOH became a major product. In fact, the onset of EtOH accumulation occurred before that of MeOAc.

TABLE 3

Percent Conversion and Methyl Acetate Percent Reaction Efficiency for Buffered Electrolysis Solution in an Undivided Cell.

| TIME | AcH-wt. % | MeOAc-wt. % | AcH RATIO | % CONVER. | AcH-DIFF. | % R.E. |
|---|---|---|---|---|---|---|
| 0.00 | 5.300 | 0.000 | 1.000 | 0.00 | 0.000 | |
| 0.67 | 5.160 | 0.000 | 0.974 | 2.64 | 0.140 | 0.00 |
| 1.42 | 4.830 | 0.159 | 0.911 | 8.87 | 0.470 | 20.13 |
| 2.16 | 4.356 | 0.566 | 0.822 | 17.81 | 0.944 | 35.67 |
| 2.75 | 4.030 | 0.875 | 0.760 | 23.96 | 1.270 | 40.99 |
| 3.50 | 3.710 | 1.282 | 0.700 | 30.00 | 1.590 | 47.97 |
| 4.16 | 3.230 | 1.731 | 0.609 | 39.06 | 2.070 | 49.76 |
| 4.83 | 2.898 | 2.019 | 0.547 | 45.32 | 2.402 | 50.01 |
| 18.08 | 0.023 | 5.563 | 0.004 | 99.57 | 5.277 | 62.72 |

See text below Table 1, supra, for TIME, AcH RATIO, and AcH-DIFF keys.

TABLE 4

Percent Conversion and Ethanol Percent Reaction Efficiency for Buffered Electrolysis Solution in an Undivided Cell.

| TIME | AcH-wt. % | EtOH-wt. % | AcH RATIO | % CONVER. | AcH-DIFF. | % R.E. |
|---|---|---|---|---|---|---|
| 0.00 | 5.300 | 0.000 | 1.000 | 0.00 | 0.000 | |
| 0.67 | 5.160 | 0.128 | 0.974 | 2.64 | 0.140 | 87.50 |
| 1.42 | 4.830 | 0.305 | 0.911 | 8.87 | 0.470 | 62.10 |

TABLE 4-continued

Percent Conversion and Ethanol Percent Reaction Efficiency for Buffered Electrolysis Solution in an Undivided Cell.

| TIME | AcH-wt. % | EtOH-wt. % | AcH RATIO | % CONVER. | AcH-DIFF. | % R.E. |
|---|---|---|---|---|---|---|
| 2.16 | 4.356 | 0.590 | 0.822 | 17.81 | 0.944 | 59.81 |
| 2.75 | 4.030 | 0.737 | 0.760 | 23.96 | 1.270 | 55.54 |
| 3.50 | 3.710 | 0.958 | 0.700 | 30.00 | 1.590 | 57.66 |
| 4.16 | 3.230 | 1.229 | 0.609 | 39.06 | 2.070 | 56.82 |
| 4.83 | 2.898 | 1.420 | 0.547 | 45.32 | 2.402 | 56.58 |

See text below Table 1, supra, for TIME, AcH RATIO and AcH-DIFF keys.

The MeOAc % R.E. values of Table 3 and the EtOH % R.E. values of Table 4 should be viewed qualitatively since GC was calibrated for AcH and MeOAc, but not for EtOH. Since the molecular weights of AcH and EtOH differ by only 2 atomic mass units (amu), GC sensitivity factors for AcH were used to estimate the amount of EtOH in the system. The data for the 18.08-hour time period was omitted from Table 4 because the EtOH % R.E. was similar to the MeOAc % R.E., reported in Table 3, after 18.08 hours.

For certain time periods (e.g., 3.50, 4.16, and 4.83 hour periods), the sum of MeOAc % R.E. from Table 3 and the corresponding value for EtOH % R.E. from Table 4 summed to values greater than 100%. This may have been a consequence of variation in calibration. However, it also seemed likely that "another source" of EtOH was manifested after longer periods of electrolysis. In addition to the reduction of AcH to EtOH at the cathodic electrode in the undivided cell, the reduction of acetic acid may have been a source of EtOH.

A trend that occurred in the buffered solutions is shown in the data of Table 5. The acetic acid content decreased with electrolysis, subsequently leveled, and then underwent a major drop, especially after long electrolysis periods (e.g., more than 18 hours). In contrast, in experiments in which unbuffered electrolysis solutions were used, a trend of a continuous increase, followed by a drop after long electrolysis periods, of acetic acid content was observed (see also Table 2).

TABLE 5

Acetic Acid Content as Area Counts During Electrolysis for Buffered Electrolysis Solution in an Undivided Cell.

| TIME | Acetic Acid AREA |
|---|---|
| 0.00 | 477888 |
| 0.67 | 352100 |
| 1.42 | 266579 |
| 2.16 | 250277 |
| 2.75 | 245151 |
| 3.50 | 242205 |
| 4.16 | 238211 |
| 4.83 | 241446 |
| 18.08 | 139280 |

See text below Table 2, supra, for TIME and Acetic Acid-AREA keys.

Conclusion. AcH was converted through electrochemical oxidation in a buffered electrolysis solution in an undivided cell, while EtOH was also generated. Processes for conversion of aldehydes in undivided cells are of particular interest where recycling of product is not contemplated.

Example 2

Electro oxidation of Aldehydes in Divided Cells

The present example provides studies conducted, among other reasons, to provide conditions in divided cells to maximize selectivity and reaction efficiency so that substantially all AcH is oxidized to MeOAc in anolyte solution. Additionally, the present example provides studies conducted to minimize $CHI_3$ formation in the anolyte solution.

Physical separation of anolyte and catholyte characterizes divided cells. Advantages of using a divided cell according to the present invention for the electrochemical oxidation of aldehydes include preventing formation of products of the opposing electrochemical reaction. For example, the formation of EtOH through the reduction at the counter electrode of AcH to EtOH is avoided. Similarly, the production of additional acetic acid through the further reduction of EtOH at the catholytic electrode is avoided.

The Divided Electrochemical Cell (FIG. 1). A reticulated vitreous carbon electrode (90) was placed in a standard 100 ml glass cell (100) as shown in the drawing. Within the cylinder formed by the reticulated carbon anodic electrode, an auxiliary electrode chamber (30) (a fritted glass tube) was placed that contained a coiled platinum cathodic electrode (40) also as shown in the drawing. The fritted glass of the auxiliary electrode chamber physically separated anolyte from catholyte. Reference numbers of the drawing refer as follows: 10, port plug; 20, o-ring; 30, auxiliary electrode chamber with fritted glass tube; 40, coiled platinum auxiliary electrode; 50, auxiliary electrode bushing; 60, reference electrode; 70, teflon gas tubing; 80, teflon cap; 90, reticulated vitreous carbon working electrode; 100, glass cell; and 110, stir bar.

Electrolyte. Electrolyte was prepared by dissolving 3.0 g of LiI and 3.5 g LiOAc, in 200 ml of MeOH:water solution. The pH of the electrolyte solution was 9.8 when the ratio (v/v) of MeOH:water was 1:1. Without further adjusting the pH, the resulting electrolyte was used as catholyte. For preparation of the anolyte, a 100 g portion of electrolyte was adjusted to a pH of 6.0 with concentrated acetic acid (reagent-grade). To 0.5 or 5.0 g AcH, pH-adjusted electrolyte solution was added to a solution weight of 100 g, forming 0.5 wt. % or 5.0 wt. % AcH concentrations, respectively. AcH solutions (5.0 wt. %) were used as anolyte in studies initially conducted to determined a preferred ratio (v/v) of MeOH:water as a solvent. In later studies conducted with minimization of $CHI_3$ formation as a goal, AcH solutions (0.5 wt. %) were used as anolyte.

Ratio (v/v) MeOH. Water. Using a divided cell as shown in the drawing, a current of 100 mA was found to be insufficient to drive the oxidation of AcH to MeOAc when catholyte and anolyte were used in which no water had been added with MeOH solvent in mixing the solutions. Accordingly, solutions of various MeOH:water ratios were tested. Catholyte and anolyte in which the MeOH:water ratio was greater than 1:1 demonstrated resistance problems. On the other hand, when water content of the solutions was increased to about 80%, white crystals of $LiIO_3$ deposited on the anodic electrode. The oxidation reaction did not proceed when anolyte containing water, but almost no MeOH, was used; with use of such anolyte, passivation of the electrode was almost immediate.

However, when the ratio of MeOH:water in anolyte was about 1:1 (v/v), oxidation of AcH to MeOAc proceeded without the production of either acetal or paraldehyde, indicating that, at such a ratio, these non-electrochemical (or non-faradaic) reactions were suppressed and oxidation was more selective toward conversion of AcH to MeOAc. A 1:1 ratio of MeOH:water was found also to be the most preferred ratio.

Acetaldehyde. 5.0 Wt. % Versus 0.5 Wt. %. When anolyte (made using an electrolyte having a MeOH:water ratio of 1:1) was used having AcH at 5.0 wt. %, yellow crystals precipitated on the surface of the anolytic electrode of the divided cell. The yellow crystals were identified as iodoform ($CHI_3$) by X-ray diffraction.

When present at 0.5 wt. %, AcH was converted to MeOAc before any appreciable formation of $CHI_3$ occurred. Lithium Iodide. The amount of LiI added in the system affected the maintenance of the oxidation. Data of Table 6 display results of a reaction wherein anolyte solution of a divided cell was charged with $4.0\times10^{-3}$ moles LiI and $2.3\times10^{-2}$ moles AcH. Whenever such molar ratio was used, the deep purple color that characterized the reaction mixture disappeared after 7 hours of electrolysis, and the solution turned yellow. For the reaction to proceed beyond this point, more LiI was added. In the experiment that generated data reported in Table 6, additional LiI was added after 18.50 hours of electrolysis. However, in this experiment, the percent conversion of AcH was low. Moreover, 1,1'-DME and $CHI_3$ also formed in small amounts during electrolysis. The amount of $CHI_3$ formed was very small; only 25 mg were recovered.

TABLE 6

Percent Conversion and Methyl Acetate Percent Reaction Efficiency for Buffered Electrolysis Solution in a Divided Cell.

| TIME | AcH-AREA | MeOAc-AREA | AcH RATIO | % CONVER. | AcH-DIFF. | % R.E. |
|---|---|---|---|---|---|---|
| 0.00 | 908483 | 0 | 1.00 | 0.00 | 0 | |
| 0.67 | 837994 | 53755 | 0.92 | 7.76 | 70489 | 45.37 |
| 1.50 | 746982 | 155802 | 0.82 | 17.78 | 161501 | 57.40 |
| 2.30 | 655689 | 257302 | 0.72 | 27.83 | 252794 | 60.56 |
| 2.83 | 619607 | 290107 | 0.68 | 31.80 | 288876 | 59.75 |
| 3.50 | 604426 | 303115 | 0.67 | 33.47 | 304057 | 59.32 |
| 18.50 | 485785 | 382356 | 0.53 | 46.53 | 422698 | 53.82 |
| 20.33 | 447915 | 339852 | 0.49 | 50.70 | 460568 | 43.90 |

See text below Table 1 for TIME, AcH-AREA, MeOAc-AREA, AcH RATIO, and AcH-DIFF keys.

On the basis of $CHI_3$ formation, the most preferred anolyte was one of 0.5 wt. % AcH (0.011 mole), 0.011 mole Li, and 0.025 mole LiOAc in 100 mL 1:1 (v/v) MeOH:water for which pH had been adjusted to between about 5.27 and 6.10. Under the conditions of the present example, use of 0.011 mole LiI was optional. If less than 0.011 mole LiI (per 100 ml) was used, the reaction eventually required additional charges of LiI regardless of the amount of AcH used in the electrolysis. An excess of LiOAc was desired since it aided solution conductivity and buffer strength.

Data of Table 7 provide % conversion and MeOAc % R.E. using these optimized anolyte solutions. Strikingly, the conversion of AcH to the ester MeOAc diminished with time. Possibly, the ester MeOAc was hydrolyzed with water in the mildly acidic media (pH-6). If hydrolysis occurred, an increase of acetic acid content would be expected. However, an early decrease in acetic acid content was observed, with a subsequent increase in acetic acid content (see Table 8). Acetic acid may be replenished by ester hydrolysis of MeOAc and, possibly, direct oxidation of AcH.

TABLE 7

Percent Conversion and Methyl Acetate Percent Reaction Efficiency for Buffered Electrolysis Solution in a Divided Cell.

| TIME | AcH-AREA | MeOAc-AREA | AcH RATIO | % CONVER. | AcH-DIFF. | % R.E. |
|---|---|---|---|---|---|---|
| 0.00 | 460101 | 0 | 1.00 | 0.00 | 0 | |
| 0.75 | 342218 | 148631 | 0.68 | 32.14 | 147883 | 59.80 |

TABLE 7-continued

Percent Conversion and Methyl Acetate Percent Reaction Efficiency for Buffered Electrolysis Solution in a Divided Cell.

| TIME | AcH-AREA | MeOAc-AREA | AcH RATIO | % CONVER. | AcH-DIFF. | % R.E. |
|---|---|---|---|---|---|---|
| 2.00 | 167936 | 326014 | 0.36 | 63.50 | 292165 | 66.39 |
| 2.59 | 63906 | 413626 | 0.14 | 86.11 | 396195 | 62.12 |
| 3.40 | 4981 | 348356 | 0.01 | 98.92 | 455120 | 45.54 |

See text below Table 1, supra, for TIME, AcH-AREA, MeOAc-AREA, AcH Ratio, and AcH-DIFF keys.

TABLE 8

Acetic Acid Content as Area Counts During Electrolysis for Buffered Electrolysis Solution in a Divided Cell.

| TIME | Acetic Acid AREA |
|---|---|
| 0.00 | 51329 |
| 0.75 | 9238 |
| 2.00 | 4385 |
| 2.59 | 17323 |
| 3.40 | 20145 |

See text below Table 2, supra, for TIME and Acetic Acid-AREA keys.

Iodoform Formation. To determine the amount of $CHI_3$ formed, three studies were performed. Percent conversion and methyl acetate reaction efficiency for buffered electrolysis solution in a divided cell were studied. The current efficiency was monitored at 1) 315 mA in one hour;

2) 330 mA reached immediately;

3) 330 mA in forty minutes.

The amount of $CHI_3$ recovered from these experiments was: $7–10^{-4}$, $1.1\times10^{-3}$, and $1.3\times10^{3}$ moles, respectively. The haloform reaction indicates that for every mole of AcH consumed, a mole of $CHI_3$ should theoretically be produced. In these studies, the yield of $CHI_3$ averaged about 9%.

Iodate. The presence of $10^{-}$is involved in the mechanism of the iodoform reaction. The formation of $10^{31}$ was noted. Its stability is somewhat improved at higher pH's (Kelsall et al., 1993, J. Electroanal. Chem. 361: 13–24). At pH~7 some HIO should exist, but at very small concentrations (Kelsall et al., 1993, J. Electroanal. Chem. 361: 13–24). Consequently, at low pH the haloform reaction is ineffective, as the experimental results indicated.

Conclusion. Formation of $CHI_3$ was avoided in the divided cell configuration by modifying conditions of electrolysis, e.g., lowering the AcH amount to 0.011 mole (per 100 ml). The ratio of the mediator LiI to AcH is in the range from 1:10 to 10: 1, with a range from 1:5 to 5:1 being preferred, and a ratio of 1:1 being most preferred. Furthermore, EtOH was no longer produced since, in the divided cell arrangement, the counter electrode (i.e., the cathodic electrode) was not in contact with AcH of the reaction solution.

Example 3

Electrooxidation of Formaldehyde

The present example provides studies conducted to test, electrooxidation of HCHO using conditions previously provided for use in AcH electrooxidation. HCHO was dissolved to 5 wt. % concentration in 200 ml 1:1 (v/v) MeOH:water solvent buffered to pH 5.25 and to which 3.0 g LiI and 3.5 g LiOAc had been added. Electrolysis in a divided cell resulted in a 44% percent conversion of HCHO after 6.7 hours. The relatively low percent conversion value was attributed in large part to deteriorating electrode conditions. Replacement of the electrode was expected to have provided higher percent conversion effects. Methyl formate formation was confirmed using retention-time matches with a known standard in GC/MS.

Conclusion. Results with HCHO demonstrated that aldehydes other than AcH may be used as substrates in electrochemical oxidation according to the present invention. In particular, electrooxidation in one embodiment of the present invention permits removal of HCHO through its oxidation to methyl formate.

Example 4

Electrooxidation In The Presence of Minimal Water

The present example provides examples of, electrooxidation of aldehydes in divided cells using as an anolyte solvent alcohols (e.g., MeOH) to which water has not been added. In one embodiment, using a divided cell as shown in FIG. 1, a current of greater than 100 mA is used to drive the oxidation of AcH to MeOAc when catholyte and anolyte are used in which no water has been added to a MeOH solvent used in mixing catholyte and anolyte. Alcohols other than MeOH may be used as solvents and the scale of the divided cell varied greatly. Electrical power sufficient to drive the electrooxidation of aldehydes in anolytes prepared using as a solvent alcohol to which water has not been added may be determined as follows. After application of electrical power, anolytes are assayed, e.g., using GC/MS procedures, for levels of target chemicals, as well as for levels of target-chemical derivatives in which aldehyde moieties are esterified with R groups of reactant alcohol. If levels consistent with faradaic processes of oxidation are present, electrical power is sufficient. If such levels of target chemicals and target-chemical derivatives are not present, the electrical power is insufficient. The application of electrical power from power supplies having greater output capacity may need to be used.

Example 5

Electrooxidation in a Continuous System

The present example provides for electrooxidation of an aldehyde moiety of target chemical to an ester moiety using a continuous system. These systems include those wherein addition of the target chemical (e.g., from a vapor process stream) to anolyte or electrolyte is continuous, and those wherein adjustment of electrooxidation conditions (e.g., of pH of anolyte or electrolyte) is continuous, e.g. as in a titration. In one embodiment, process streams, undiluted or diluted, are added continuously to anolyte at a rate wherein the wt. % of AcH in the anolyte is kept below 0.5%, that is, wherein AcH is removed from the anolyte as MeOAc at a rate at least equal to the rate of its addition to the anolyte.

Process streams or source solutions other than those generated in the manufacture of acetic acid may be used as feed. For example, in another embodiment, AcH-containing feed generated in the commercial production of vinyl acetate may be added continuously to an electrooxidation system from which AcH is continuously removed as MeOAc.

Similarly, feed containing other target chemicals such as, for illustration, crotonaldehyde, 2-ethylcrotonaldehyde, butyraldehyde, and/or 2-ethylbutyraldehyde may be added continuously to an electrooxidation system from which these aldehydes are continuously removed as alcohol esters.

A continuous system may also include a system of electrolysis cells connected in tandem.

What is claimed is:

1. A process for oxidizing an aldehyde moiety of a target chemical to an ester moiety in a divided electrochemical cell, the process having a hemiacetal intermediate, comprising:

preparing an anolyte comprising combining an alcohol, a source of halide, a buffering agent, and water to form an electrolyte, adjusting the electrolyte to a pH at about which the hemiacetal is favored over acetal formation, and adding the target chemical;

placing the anolyte in contact with an anodic electrode of the divided cell;

placing a catholyte in contact with a cathodic electrode of the divided cell; and applying electrical power to the cell, wherein the electrical power has an amperage or voltage, and wherein the applying is for a time period, sufficient to oxidize the aldehyde moiety to the ester moiety, wherein the target chemical is selected from the groupe consising of acetaldehyde and formaldehyde.

2. The process of claim 1 wherein the target chemical is acetaldehyde, and the alcohol is methanol.

3. A process for oxidizing acetaldehyde to methyl acetate in a divided electrochemical cell, comprising:

preparing an anolyte comprising combining methanol, lithium iodide, lithium acetate, and water to form an electrolyte, adjusting the electrolyte to a pH of between about pH 4.0 and pH 9.0, and adding acetaldehyde;

placing the anolyte in contact with an anodic electrode of the divided cell;

placing a catholyte in contact with a cathodic electrode of the divided cell; and applying electrical power to the cell, wherein the electrical power has an amperage or voltage, and wherein the applying is for a time period, sufficient to oxidize the acetaldehyde to methyl acetate.

4. A process for oxidizing an aldehyde moiety of a target chemical to an ester moiety in an undivided electrochemical cell, the process having a hemiacetal intermediate, comprising:

preparing an electrolyte comprising an alcohol, a source of halide, a buffering agent, water, and the target chemical;

adjusting the electrolyte to a pH at about which the hemiacetal is favored over acetal formation;

placing the electrolyte in contact with an anodic electrode and with a cathodic electrode of the undivided cell; and applying electrical power to the cell, wherein the electrical power has an amperage or voltage, and wherein the applying is for a time period, sufficient to oxidize the aldehyde moiety to the ester moiety, wherein the target chemical is selected from the group consisting of acetaldehyde and formaldehyde.

5. The process of claim 4 wherein the target chemical is acetaldehyde, and the alcohol is methanol.

6. A process for oxidizing acetaldehyde to methyl acetate in an undivided electrochemical cell, comprising:

preparing an electrolyte comprising methanol, lithium halide, lithium acetate, acetaldehyde, and water;

adjusting the electrolyte to a pH of between about pH 5 and pH 6.5, placing the electrolyte in contact with an anodic electrode and with a cathodic electrode of the undivided cell; and applying electrical power to the cell, wherein the electrical power has an amperage or voltage, and wherein the applying is for a time period, sufficient to the oxidize acetaldehyde to methyl acetate.

7. A process for lowering acetaldehyde concentration in a process stream from acetic acid manufacture laving a carbonylation cycle, and returning a process stream of acetaldehyde-lowered product to the carbonylation cycle, the process having a hemiacetal intermediate and using a divided electrochemical cell, the process comprising:

preparing an anolyte comprising combining an alcohol, a source of halide, a buffering agent, and water to form an electrolyte, adjusting the electrolyte to a pH at about which the hemiacetal if favored over acetal formation, and adding the process stream from acetic acid manufacture;

placing the anolyte in contact with an anodic electrode of the divided cell;

placing a catholyte in contact with a cathodic electrode of the divided cell;

applying electrical power to the cell to form a process stream of acetaldehyde-lowered product; and returning the process stream of acetaldehyde-lowered product to the carbonylation cycle, wherein the electrical power has an amperage or voltage, and wherein the applying is for a time period, sufficient to oxidize the acetaldehyde to an ester.

* * * * *